US009570849B2

(12) United States Patent
Paynter

(10) Patent No.: US 9,570,849 B2
(45) Date of Patent: Feb. 14, 2017

(54) FLOAT PLATE FOR BLIND MATABLE ELECTRICAL CABLE CONNECTORS

(71) Applicant: CommScope Technologies LLC, Hickory, NC (US)

(72) Inventor: Jeffrey D. Paynter, Momence, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 14/166,445

(22) Filed: Jan. 28, 2014

(65) Prior Publication Data

US 2015/0126061 A1 May 7, 2015

Related U.S. Application Data

(60) Provisional application No. 61/900,056, filed on Nov. 5, 2013.

(51) Int. Cl.
*H01R 13/64* (2006.01)
*H01R 13/631* (2006.01)

(52) U.S. Cl.
CPC ..... *H01R 13/6315* (2013.01)

(58) Field of Classification Search
CPC ..... H01R 13/6315; H01R 2103/00
USPC ..... 439/247, 248, 578
See application file for complete search history.

(56) References Cited

U.S. PATENT DOCUMENTS

| | | | | |
|---|---|---|---|---|
| 1,697,954 | A * | 1/1929 | Gribbie | 439/883 |
| 3,566,334 | A * | 2/1971 | Ziegler, Jr. | 439/248 |
| 3,745,513 | A * | 7/1973 | Gross | 439/436 |
| 4,950,173 | A * | 8/1990 | Minemura | H05K 3/326 439/161 |
| 5,931,695 | A | 8/1999 | Scully et al. | |
| 5,980,321 | A * | 11/1999 | Cohen et al. | 439/607.09 |
| 7,074,080 | B1 * | 7/2006 | Khemakhem et al. | 439/578 |
| 7,607,930 | B1 * | 10/2009 | Wu | 439/247 |
| 7,670,177 | B2 | 3/2010 | Myer et al. | |
| 8,366,469 | B2 * | 2/2013 | Carnevali | 439/248 |
| 8,622,762 | B2 * | 1/2014 | Van Swearingen et al. | 439/248 |
| 8,936,485 | B2 * | 1/2015 | Gessford et al. | 439/578 |
| 2005/0191868 | A1 | 9/2005 | Beck et al. | |
| 2008/0020618 | A1 | 1/2008 | Feldman | |
| 2013/0065415 | A1 | 3/2013 | Van Swearingen et al. | |

OTHER PUBLICATIONS

International Search Report and Written Opinion for corresponding PCT Application No. PCT/US2014/063627, date of mailing Jan. 19, 2015,14 pages.

* cited by examiner

*Primary Examiner* — Thanh Tam Le
(74) *Attorney, Agent, or Firm* — Myers Bigel P.A.

(57) ABSTRACT

A float plate for a connector interface includes: at least one substantially planar body panel; at least one opening in the body panel, the opening having a perimeter; and a plurality of fingers extending from the perimeter of the opening within a plane defined by the body panel, each finger extending from the perimeter at an oblique angle to a diameter of the opening originating at a fixed end of the finger.

15 Claims, 6 Drawing Sheets

FLOAT PLATE FOR BLIND MATABLE ELECTRICAL CABLE CONNECTORS

RELATED APPLICATION

The present application claims the benefit of and priority from U.S. Provisional Patent Application No. 61/900,056, filed Nov. 5, 2013, the disclosure of which is hereby incorporated by reference herein in its entirety.

FIELD OF THE INVENTION

This invention relates generally to electrical cable connectors and, more particularly, to connectors with a blind matable connection interface.

BACKGROUND

Coaxial cables are commonly utilized in RF communications systems. Coaxial cable connectors may be applied to terminate coaxial cables, for example, in communication systems requiring a high level of precision and reliability.

Connector interfaces provide a connect/disconnect functionality between a cable terminated with a connector bearing the desired connector interface and a corresponding connector with a mating connector interface mounted on an apparatus or a further cable. Some coaxial connector interfaces utilize a retainer (often provided as a threaded coupling nut) that draws the connector interface pair into secure electro-mechanical engagement as the coupling nut, rotatably retained upon one connector, is threaded upon the other connector. Alternatively, connection interfaces may be also provided with a blind mate characteristic to enable push-on interconnection, wherein physical access to the connector bodies is restricted and/or the interconnected portions are linked in a manner where precise alignment is difficult or not cost-effective (such as the connection between an antenna and a transceiver that are coupled together via a rail system or the like). To accommodate misalignment, a blind mate connector may be provided with lateral and/or longitudinal spring action to accommodate a limited degree of insertion misalignment. Prior blind mate connector assemblies may include one or more helical coil springs, which may increase the complexity of the resulting assembly and/or require additional assembly depth along the longitudinal axis.

SUMMARY

As a first aspect, embodiments of the invention are directed to a float plate for a connector interface, comprising: at least one substantially planar body panel; at least one opening in the body panel, the opening having a perimeter; and a plurality of fingers extending from the perimeter of the opening within a plane defined by the body panel, wherein the fingers are configured to enable a connector inserted into the opening to adjust its position radially and axially.

As a second aspect, embodiments of the invention are directed to a connector interface, comprising a float plate for a connector interface and a first connector. The float plate comprises: at least one substantially planar body panel; at least one opening in the body panel, the opening having a perimeter; and a plurality of fingers extending from the perimeter of the opening within a plane defined by the body panel, wherein the fingers are configured to enable a connector inserted into the opening to adjust its position radially and axially. The first connector is inserted into the opening and in contact with the fingers.

As a third aspect, embodiments of the invention are directed to a float plate for a connector interface, comprising: at least one substantially planar body panel formed of a first material; at least one opening in the body panel; and a generally annular grommet mounted in the opening, the grommet being formed of a second material that is different from the first material and including an internal ridge configured to grasp a connector and enable the connector to adjust its position radially and axially.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
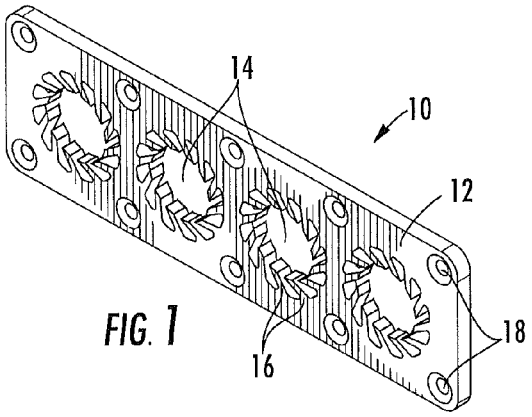
FIG. 1 is a perspective view of a float plate with four openings to receive blind mated interconnections according to embodiments of the present invention.
Figure 2:
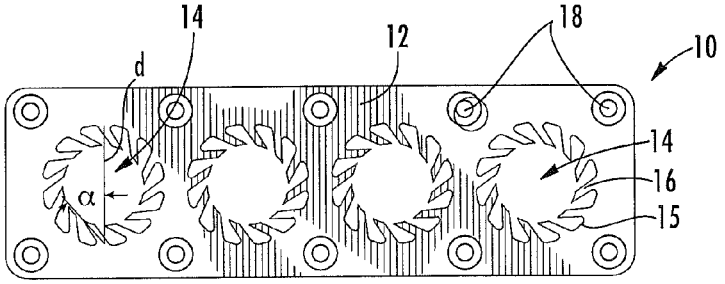
FIG. 2 is a front view of the float plate of FIG. 1.
Figure 3:
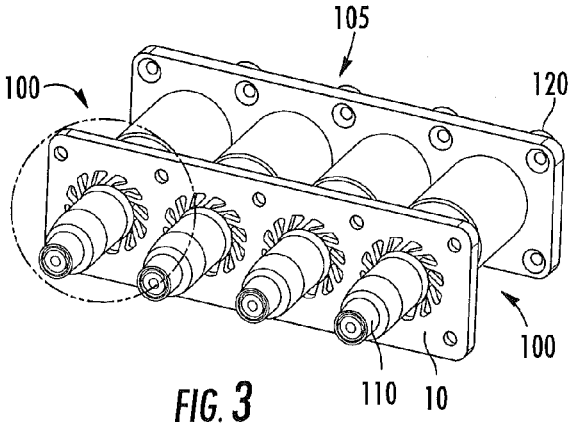
FIG. 3 is a perspective view of an assembly that includes four pairs of coaxial connectors inserted into two float plates of FIG. 1.
Figure 3A:
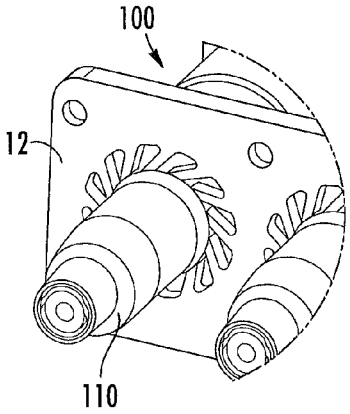
FIG. 3A is an enlarged perspective view of one of the coaxial connectors of the assembly of FIG. 3.
Figure 4:
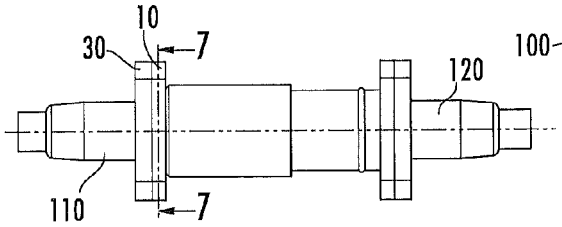
FIG. 4 is a side view of the assembly of FIG. 3 mounted to a rigid structure.
Figure 5:
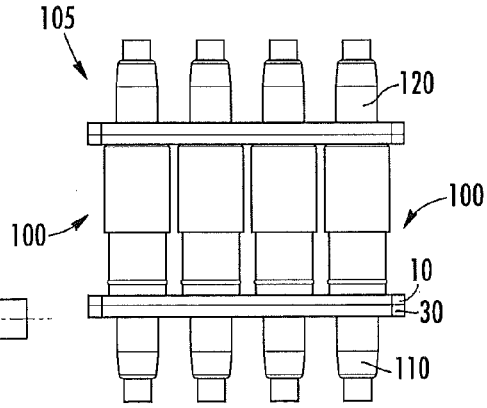
FIG. 5 is a top view of the assembly of FIG. 4.

FIGS. 1 and 2 illustrate a float plate, designated broadly at 10, according to embodiments of the invention. The float plate 10 may provide interconnection sites for blind matable connectors.

The float plate 10 includes a main body panel 12 with four generally round openings 14, each having a perimeter 15. Each of the openings 14 includes a plurality of fingers 16. As can be seen best in FIG. 2, the fingers 16 extend generally radially inwardly from the perimeter 15 within the plane of the main body panel 12, but each finger 16 is canted such that it forms an oblique angle $\alpha$ with a diameter d of the opening 14 that originates at the fixed end of the finger 16 (see FIG. 2). The angle $\alpha$ is typically between about 30 and 70 degrees. The fingers 16 are illustrated as being generally constant in width and thickness; however, in some embodiments the fingers 16 may be tapered in either or both of width and thickness. The main body panel 12 also includes eight mounting holes 18.

The float plate 10 is typically formed as a unitary member to simplify manufacturing. In some embodiments, the float plate 10 comprises a polymeric material or a metallic material, such as stainless steel, phosphor bronze, beryllium copper, or the like, that permits flexure of the fingers 16 both within the plane of the main body panel 12 and normal to the plane of the main body panel 12.

The float plate 10 may receive blind mated coaxial connectors within each opening 14; four such interconnections, designated at 100, are shown in FIGS. 3-7 as part of an assembly 105. The float plate 10 is typically mounted to a rigid structure 30 (see FIGS. 4-6), such as a diplexer, radio head, antenna or the like, that includes openings 32 that align with the openings 14 in the float plate 10. As used herein, the examples of rigid structures noted above is intended to include housings, adapters and the like that may provide mounting locations for the float plate. The openings 32 in the rigid structure 30 are sufficiently large that they do not interfere with flexure of the fingers 16 normal to the main body panel 12. Exemplary environments in which float plates may be employed with blind matable connectors are discussed in U.S. Patent Publication No. 2013/0065415 to Van Swearingen et al., the disclosure of which is hereby incorporated herein by reference in its entirety.

As can be understood with reference to FIGS. 3-7, as a connector 110 is inserted into the float plate 10, the fingers 16 can flex to help to compensate for any misalignment of the connector 110 relative to its mating connector 120. Such misalignment is not uncommon due to minor tolerance differences in the sizes of the connectors 110, 120 and their components. If a connector 110 is misaligned in the radial direction (i.e., if the connector 110 is not "centered" within the opening 14), the fingers 16 can flex within the plane of the main body panel 12 (i.e., within the plane of the page in FIGS. 6 and 7) to enable the connector 110 to move within the opening 14 as needed. Also, by flexing within the plane of the main body panel 12, the fingers 16 tend to bias the connector 110 toward the center of the opening 14.

Figure 6:
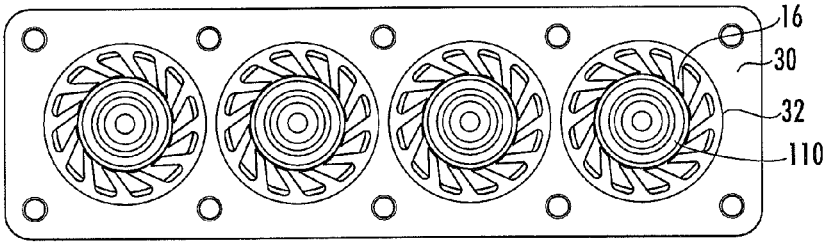
FIG. 6 is a front view of the assembly of FIG. 4.
Figure 7:
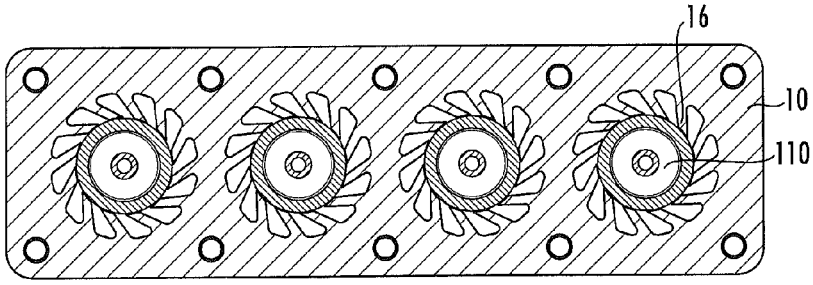
FIG. 7 is a front section view taken along line 7-7 of FIG. 4.

If instead (or in addition) the connector 110 is misaligned in the axial direction (i.e., it protrudes or is recessed normal to the plane of the main body panel 12, or, in other words, perpendicular to the page in FIGS. 6 and 7), the fingers 16 flex in a direction normal to the plane of the main body panel 12 to enable the connector 110 to move as needed for interconnection. Again, the flexing of the fingers 16 normal to the plane of the main body panel 12 tends to bias the connector 110 toward the plane of the main body panel 12.

Further, in some situations the mating connectors 110, 120 may require angular adjustment to mate. Angular adjustment is needed if a connector must rotate on an axis that is normal to the axis of the connector itself. Such rotation may be required, for example, if two float plates are slightly misaligned such that they are not parallel to each other; in such circumstances, one or both of the connectors 110, 120 contained therein must rotate slightly about an axis normal to the axis of the connector to enable the connectors to mate. This movement may cause some or all of the fingers 16 to flex both within and outside of the plane of the main body panel 12.

Those of skill in this art will recognize that the float plate 10 may take other forms than that illustrated and described above. For example, the float plate 10 may have fewer or more openings 14. There may be more or fewer fingers 16 per opening than the twelve illustrated herein; moreover, the fingers 16 may take a different shape and/or may be disposed at a different angle $\alpha$ than shown herein. Also, the float plate 10 is discussed in connection with blind matable coaxial connectors, but may be suitable for use with other types of connectors.

Figure 8:
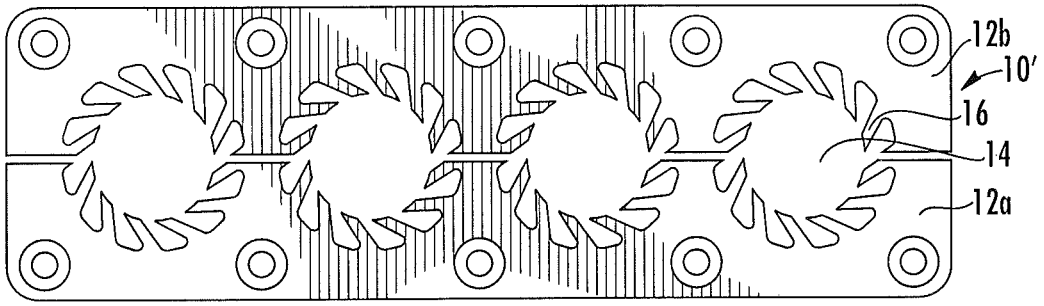
FIG. 8 is a front view of a float plate according to alternative embodiments of the invention.
Figure 9:
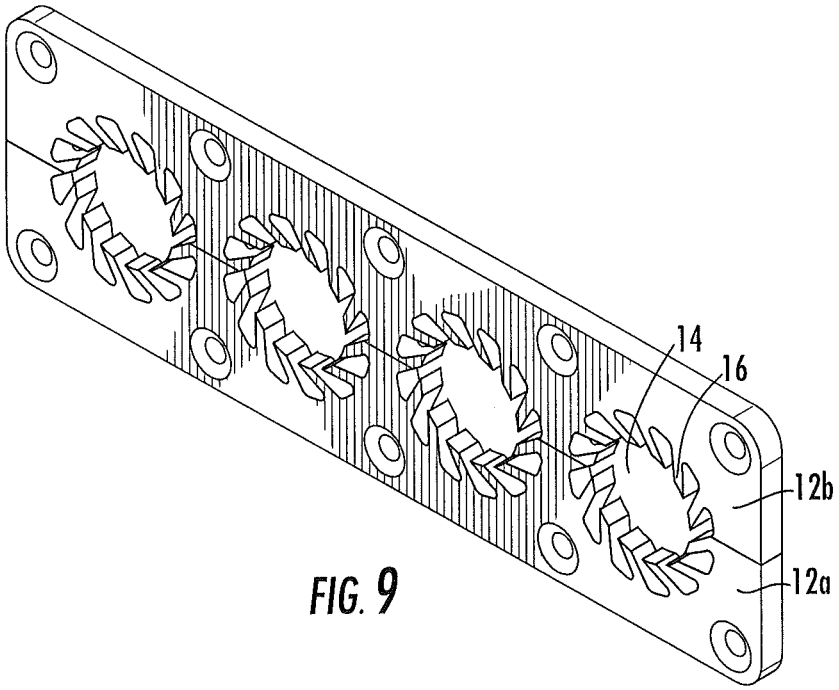
FIG. 9 is a perspective view of the float plate of FIG. 8.
Figure 10:
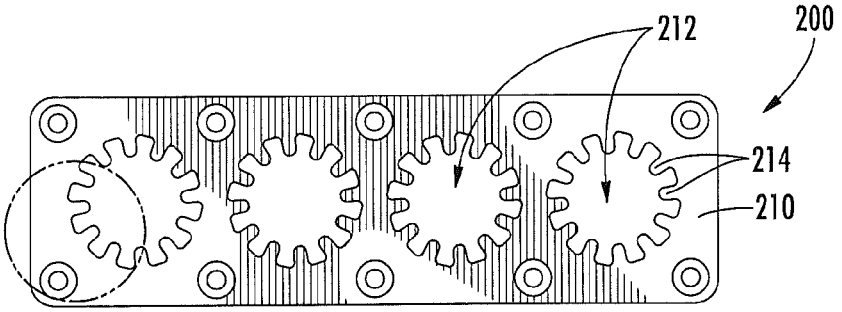
FIG. 10 is a front view of a float plate according to alternative embodiments of the invention.
Figure 11:
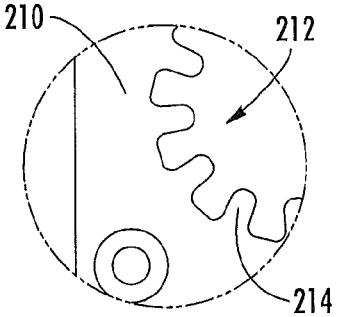
FIG. 11 is an enlarged partial view of the float plate of FIG. 10.
Figure 13:
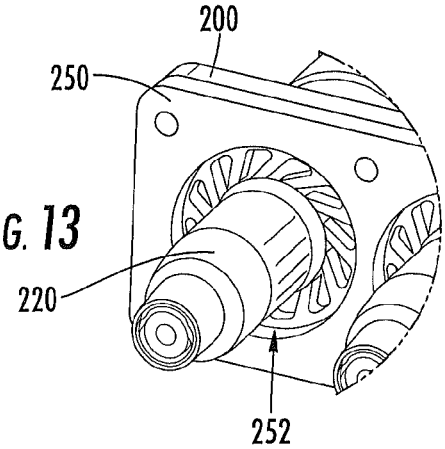
FIG. 13 is an enlarged perspective view of one of the connectors of FIG. 12 as it is received in the float plate of FIG. 10.
Figure 12:
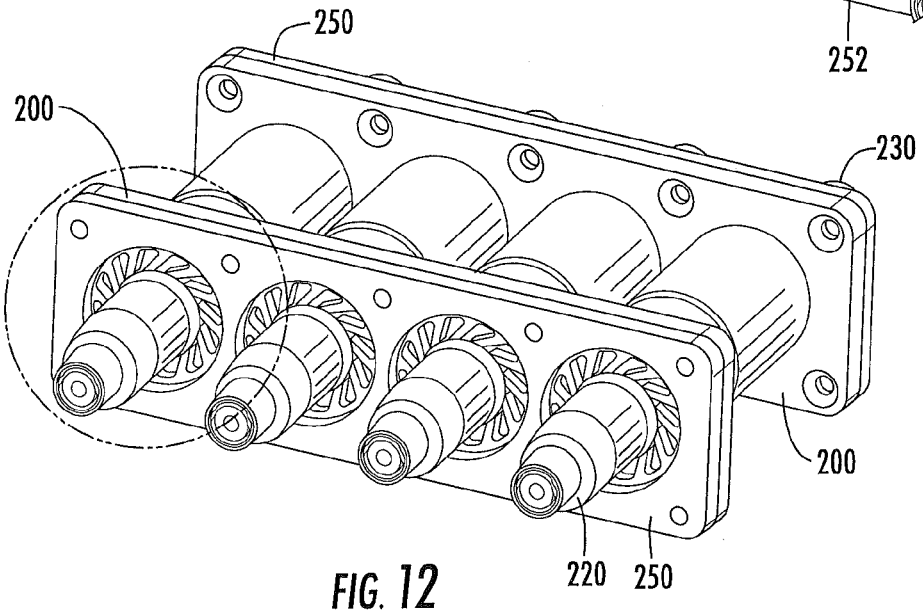
FIG. 12 is a perspective view of two float plates of FIG. 10 mounted onto rigid structures and with four coaxial connector pairs received therein.
Figure 14:
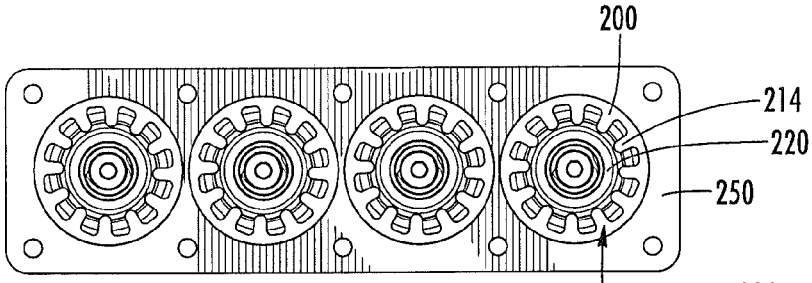
FIG. 14 is a front view of the float plate and rigid structure of FIG. 12.
Figure 15:
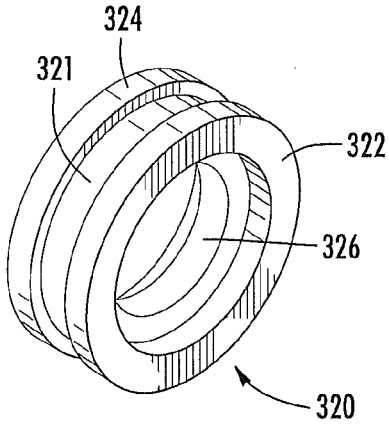
FIG. 15 is a perspective view of a grommet to be used with a float plate according to alternative embodiments of the invention.

FIGS. 8 and 9 illustrate another embodiment of a float plate, designated broadly at 10'. Rather than having a single main body panel 12 as is the case with the float plate 10, the float plate 10' includes two separate body panels 12*a*, 12*b*, which combine to form the float plate 10'. The float plate 10' includes openings 14 (formed by the combination of the body panels 12*a*, 12*b*) and fingers 16 similar to those described above. Those skilled in this art will appreciate that other numbers of body panels may also be combined to form a float plate suitable for use as discussed above.

FIGS. 10-14 illustrate a further embodiment of a float plate, designated broadly at 200. The float plate 200 comprises a panel 210 with corresponding openings 212. The openings 212 of the gripping panel 210 are generally round, but they include radially inwardly-extending fingers 214 (see FIGS. 10 and 11).

The panel 210 is typically formed of a flexible material, typically a polymeric material such as a hard rubber or thermoplastic elastomer (TPE). Thus, the fingers 214 are able to flex both within and normal to the plane defined by the panel 210 when a connector 220 is inserted therein, thereby allowing the connector 220 to shift its position both radially and axially relative to the float plate 200.

The float plate 200 can be attached to a rigid structure, such as a diplexer, radio head, antenna or the like, as described above (represented in FIGS. 12-14 at 250 with openings 252). The flexure of the fingers 214 as they hold the connector pairs 220, 230 can facilitate blind mating with other connectors (see FIG. 12), and in particular can facilitate the mating of multiple connectors at once.

Those of skill in this art will recognize that the float plate 200 may take other forms than that illustrated and described above. For example, the float plate 200 may have fewer or more openings 212. There may be more or fewer fingers 214 per opening than the twelve illustrated herein; moreover, the fingers 214 may take a different shape and/or may be disposed at a different angle than shown herein. Also, the float plate 200 is discussed in connection with blind matable coaxial connectors, but may be suitable for use with other types of connectors.

FIGS. 15-20 illustrate a still further embodiment of a float plate, designated broadly at 300. The float plate 300 includes a panel 310 with round openings 312. An annular grommet 320 (FIG. 15) resides in each of the openings 312. Each grommet 320 includes a body 321, external ridges 322, 324 on opposite axial ends of the body 321, and an internal ridge 326 that extends radially inwardly from a central portion of the inner surface of the body 321. The grommet 320 is typically formed of a flexible material, typically a polymeric material such as a hard rubber or TPE.

Figure 16:
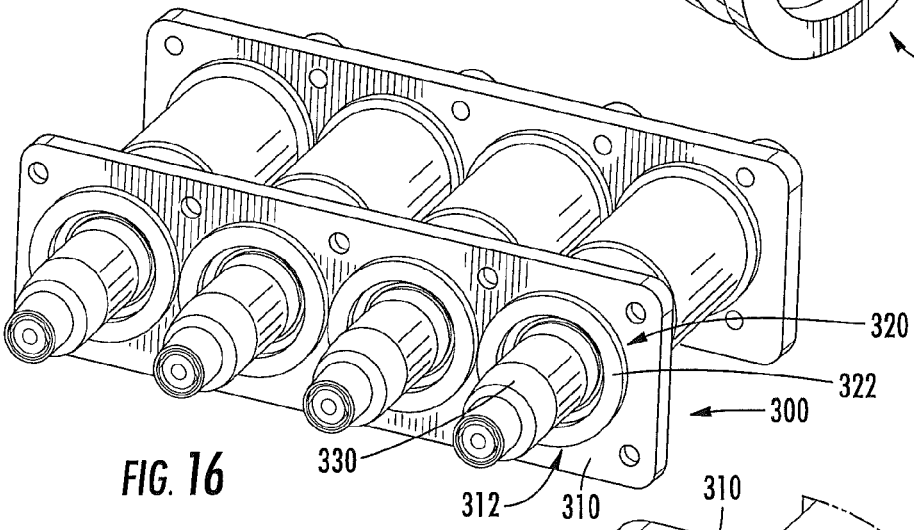
FIG. 16 is a perspective view of two float plates in which four grommets of FIG. 15 are mounted, wherein four coaxial connector pairs are received in the grommets.
Figure 17:
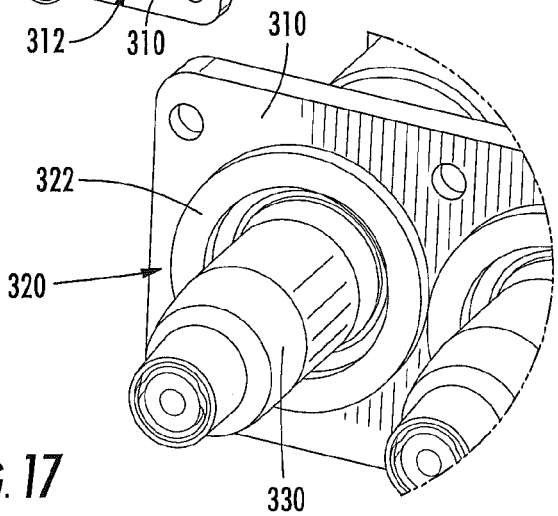
FIG. 17 is an enlarged perspective view of one of the connectors of FIG. 16 as it is received in the grommet of FIG. 15.
Figure 18:
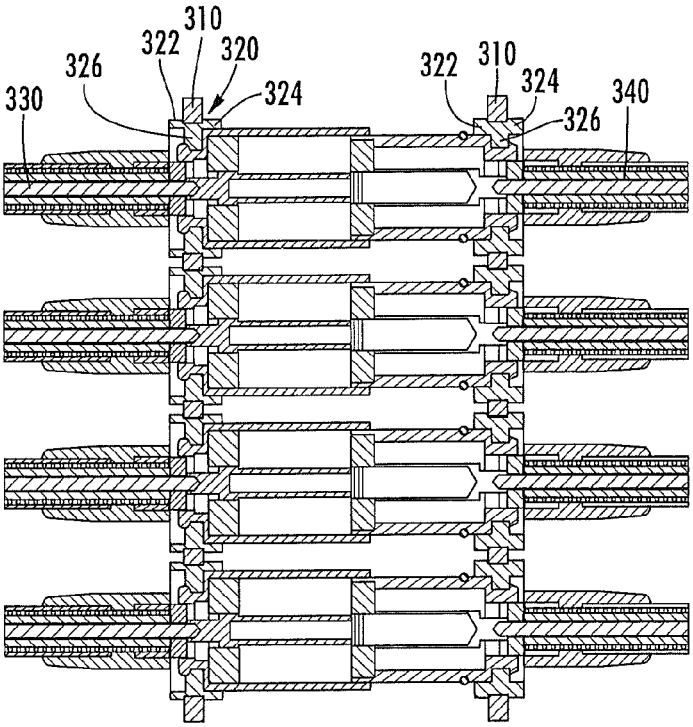
FIG. 18 is a top section view of the float plate, grommets and connectors of FIG. 16 taken along lines 18-18 of FIG. 20.
Figure 19:
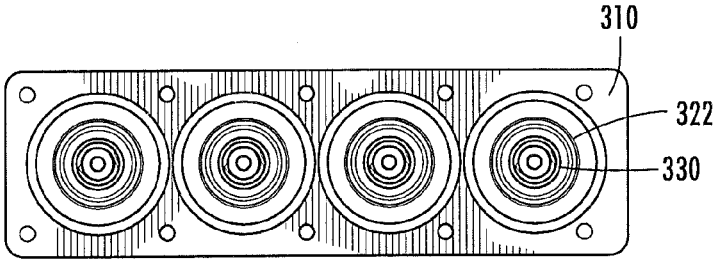
FIG. 19 is a front view of the float plate, grommets and connectors of FIG. 16.
Figure 20:
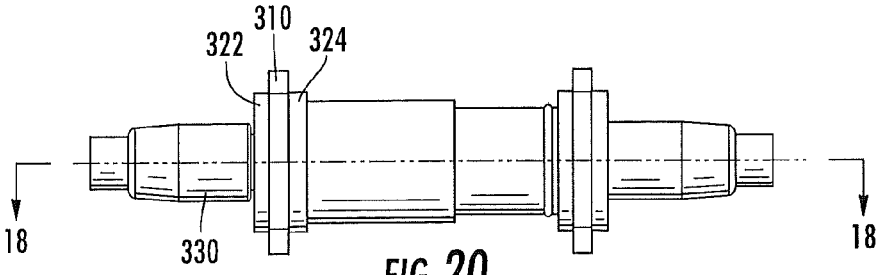
FIG. 20 is a side view of the float plate, grommets and connectors of FIG. 16.

As can be seen in FIGS. 16-18, each grommet 320 fits within a respective opening 312 of the panel 310 such that the external ridges 322, 324 abut opposed surfaces of the panel 310. A connector 330 can then be inserted through the grommet 320, with the internal ridge 326 being received in a groove in the connector 330. The flexibility of the grommet 330 enables the connector 330 to adjust its position relative to the panel 310 axially and/or and radially to facilitate mating with a mating connector 340 (see FIGS. 18-20).

Those of skill in this art will recognize that the float plate 300 may take other forms than that illustrated and described above. For example, the float plate 300 may have fewer or more openings 312. The grommet 320 may lack one of the external ridges 322, 324; also, either of the external ridges 322, 324 may be discontinuous rather than describing a full circle around the body 321 of the grommet 320. Further, the internal ridge 326 may be discontinuous within the body 321 of the grommet. Moreover, the float plate 300 is discussed in connection with blind matable coaxial connectors, but may be suitable for use with other types of connectors.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What which is claimed is:

1. A float plate for a connector interface, comprising:
at least one substantially planar body panel;
a plurality of openings in the body panel, each of the openings having a perimeter; and
a plurality of fingers extending from the perimeter of each of the openings within a plane defined by the body panel, wherein the fingers are configured to engage a coaxial connector inserted into each opening and enable the coaxial connector to adjust a position of the coaxial connector radially, angularly and axially, wherein the coaxial connector includes an inner conductor contact, a dielectric spacer circumferentially surrounding the inner conductor contact, and an outer conductor body circumferentially surrounding the dielectric spacer.

2. The float plate defined in claim 1, wherein the fingers are configured to flex within the plane defined by the body panel and normal to the plane defined by the body panel.

3. The float plate defined in claim 1, wherein each finger extends from the perimeter at an oblique angle to a diameter of the opening originating at a fixed end of the finger.

4. The float plate defined in claim 3, wherein the oblique angle is between about 30 and 70 degrees.

5. The float plate defined in claim 1, wherein the float plate is a unitary member.

6. The float plate defined in claim 1, wherein the body panel comprises a polymeric or metallic material.

7. The float plate defined in claim 1, wherein the float plate is mounted to a rigid structure comprising a diplexer, radio head, or antenna.

8. A connector interface, comprising:
(a) a float plate for a connector interface, comprising:
at least one substantially planar body panel;
a plurality of openings in the body panel, each of the openings having a perimeter; and
a plurality of fingers extending from the perimeter of each of the openings within a plane defined by the body panel; and
(b) a first plurality of coaxial connectors, wherein each of the coaxial connectors includes an inner conductor contact, a dielectric spacer circumferentially surrounding the inner conductor contact, and an outer conductor body circumferentially surrounding the dielectric spacer, each of the coaxial connectors inserted into one of the openings in the body panel and in contact with the fingers of the opening; wherein the fingers are configured to enable each coaxial connector inserted into the opening to adjust a position of the coaxial connector radially, angularly and axially.

9. The connector interface defined in claim 8, wherein the fingers are configured to flex within the plane defined by the body panel and normal to the plane defined by the body panel.

10. The connector interface defined in claim 8, wherein each finger extends from the perimeter at an oblique angle to a diameter of the opening originating at a fixed end of the finger.

11. The connector interface defined in claim 10, wherein the oblique angle is between about 30 and 70 degrees.

12. The connector interface defined in claim 8, wherein the float plate is a unitary member.

13. The connector interface defined in claim 8, wherein the body panel comprises a polymeric or metallic material.

14. The connector interface defined in claim 8, wherein the float plate is mounted to a rigid structure comprising a diplexer, radio head or antenna.

15. The connector interface defined in claim 8, further comprising a second plurality of connectors mated with the first coaxial connectors.

* * * * *